US010808699B2

(12) United States Patent
Joseph et al.

(10) Patent No.: US 10,808,699 B2
(45) Date of Patent: Oct. 20, 2020

(54) SUCTION SIDE SLIDE VALVE FOR A SCREW COMPRESSOR

(71) Applicant: Ingersoll-Rand Company, Davidson, NC (US)

(72) Inventors: Sam Palliathu Joseph, Karnataka (IN); Lova Raju Pothabattula, Karnataka (IN)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 292 days.

(21) Appl. No.: 15/718,799

(22) Filed: Sep. 28, 2017

(65) Prior Publication Data

US 2019/0093657 A1 Mar. 28, 2019

(51) Int. Cl.
*F04C 28/12* (2006.01)
*F04C 18/16* (2006.01)

(52) U.S. Cl.
CPC ..... *F04C 28/125* (2013.01); *F04C 18/16* (2013.01); *F04C 2240/811* (2013.01)

(58) Field of Classification Search
CPC ..... F04C 28/125; F04C 18/16; F04C 18/224; F04C 18/811
USPC ..... 417/301; 418/201.2
See application file for complete search history.

(56) References Cited

U.S. PATENT DOCUMENTS 3,088,658 A * 5/1963 Wagenius ..... F04C 18/16 418/201.2
3,874,828 A * 4/1975 Herschler ..... F04C 28/125 418/87
3,936,239 A 2/1976 Shaw
4,281,975 A * 8/1981 Blackwell ..... F04C 28/12 418/201.2
4,575,323 A 3/1986 Yoshimura
4,583,373 A 4/1986 Shaw
4,610,612 A 9/1986 Kocher
4,727,725 A 3/1988 Nagata et al.
4,802,457 A * 2/1989 Oscarsson ..... F02D 9/02 123/559.1
5,183,395 A * 2/1993 Langouet ..... F04C 28/125 417/310
5,352,098 A * 10/1994 Hood ..... F04C 28/14 417/282

(Continued)

FOREIGN PATENT DOCUMENTS

GB 1 370 100 * 10/1974

OTHER PUBLICATIONS

Sullair Corporation-TS Series—Rotary Screw Air Compressors; brochure for compressed air product, Sullair Corporation, 3700 E Michigan Blvd, Michigan City, IN 46360 or www.sullair.com (24 pages).

(Continued)

*Primary Examiner* — Charles G Freay
(74) *Attorney, Agent, or Firm* — Taft Stettinius & Hollister LLP

(57) ABSTRACT

The present disclosure is directed to a screw compressor system having a rotor housing with a pair of screw rotors rotatably supported within a compression chamber. A suction side slide valve is in fluid communication with an inlet to the compression chamber. The suction side slide valve is movable between a closed position and a fully open position to define a variable suction side inlet volume for controlling capacity of the compressor.

12 Claims, 7 Drawing Sheets

(56) References Cited

U.S. PATENT DOCUMENTS

| | | | | |
|---|---|---|---|---|
| 5,950,443 | A * | 9/1999 | Meyer | F04C 28/00 417/292 |
| 2008/0206086 | A1 * | 8/2008 | Bush | F01C 21/106 418/201.2 |
| 2008/0286087 | A1 | 11/2008 | Nagesh et al. | |

OTHER PUBLICATIONS

Sullair Corporation TS-32 Series Air Compressor product brochure with features, options and specifications, Sullair Corporation, 3700 E. Michigan Blvd, Michigan City, IN 46360 or www.sullair.com (2 pages).

* cited by examiner

SUCTION SIDE SLIDE VALVE FOR A SCREW COMPRESSOR

TECHNICAL FIELD

The present application generally relates to industrial air compressor systems and more particularly, but not exclusively, to a compressor system with suction volume type of capacity control, having a suction side slide valve.

BACKGROUND

Industrial compressor systems are configured to produce a pressurized fluid such as compressed air or the like, defined as "capacity." Screw compressors are typically designed for peak efficiency at full capacity (load) operation. The use of capacity control technology enables the compressor to match supply of compressed fluid (capacity or load) to changes in demand, almost always a decrease from the full load capacity. This also results in a proportional reduction of power. The prior art methods of capacity control in twin screw, air compressors are Inlet valve throttling and variable speed control, which have inherent inefficiencies on either of the mechanical and/or the electrical sides.

The prior art methods of capacity control cause compressor efficiency to decrease substantially at increasing part load operation, when implemented on fixed geometry machines. Part load efficiency can be increased with sliding valve rotor housings. Some existing systems have various shortcomings, drawbacks, and disadvantages relative to certain applications. Accordingly, there remains a need for further contributions in this area of technology.

SUMMARY

One embodiment of the present application is a compressor system with a slide valve having placement close to the suction side. Other embodiments include apparatuses, systems, devices, hardware, methods, and combinations for methods for using a suction side slide valve for part load compressor operation. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
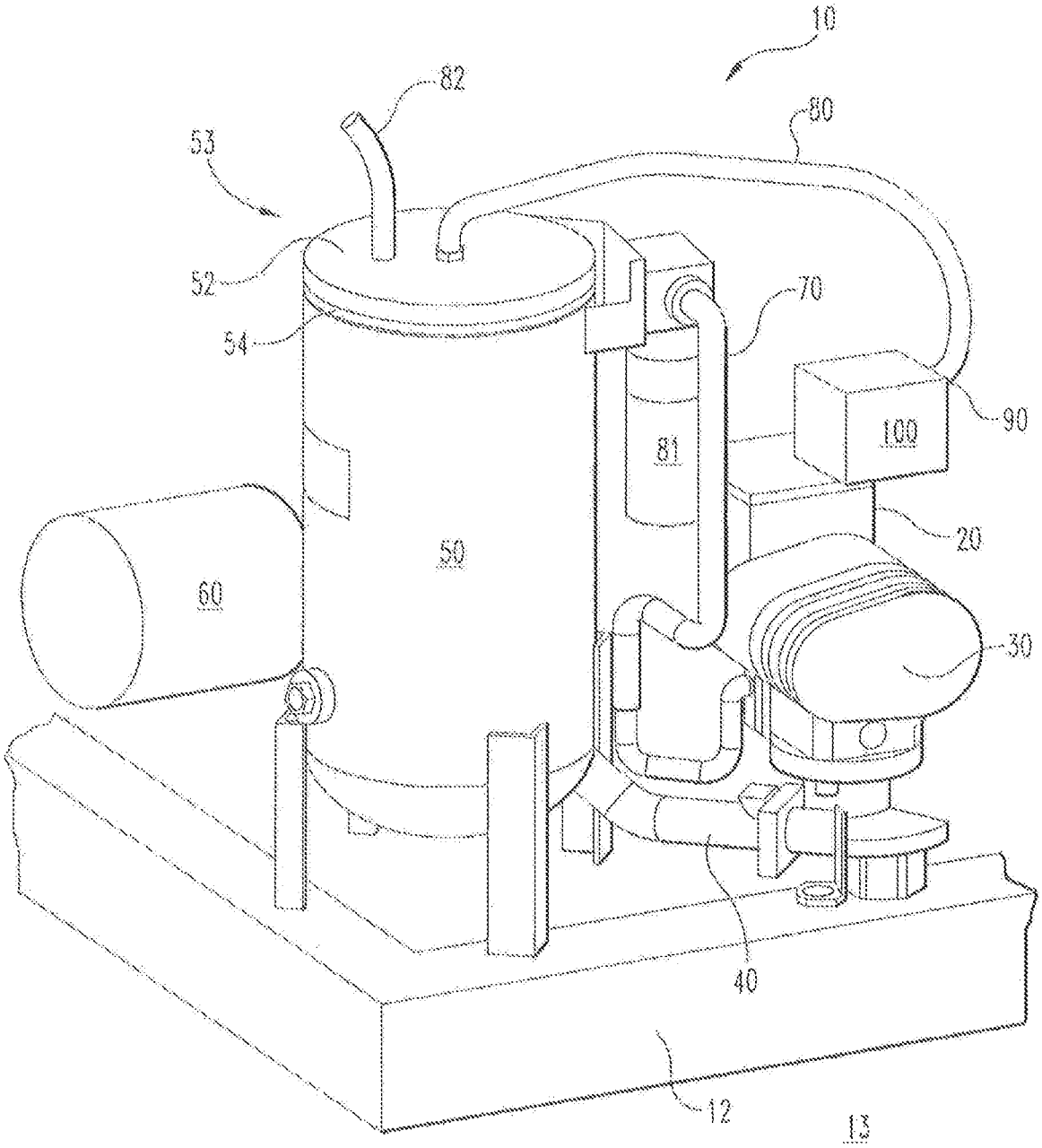
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide large quantities of compressed fluids at a desired temperature, pressure and mass flow rate. Some compressor systems include fluid to fluid heat exchangers to control the temperature of a compressed fluid at various stages within the system. The term "fluid" should be understood to include any gas, vapor (wet, dry, saturated or superheated) or liquid medium used in the compressor system as disclosed herein. In one aspect the fluid can include mixtures of air and oil and can be separated into separate constituents in a separating tank. It should be understood that when the term "air" is used in the specification or claims that other working fluids are included under a broad definition of compressible fluids. Also, when the term "oil" is used in the specification or claims, it should be understood that any lubrication fluid whether carbon based or synthetic in nature, injected into the compression chamber resulting in a dispersed phase, is contemplated herein.

Referring now to FIG. 1, an exemplary compressor system 10 is shown therein. The compressor system 10 includes a primary motive source 20 such as an electric motor, an internal combustion engine or a fluid-driven turbine and the like. The compressor system 10 can include a compressor 30 that may include multi-stage compression. The compressor 30 can include screw rotors operable to compress a working fluid such as air and oil mixture or the like.

A structural base 12 is configured to support at least portions of the compressor system 10 on a support surface 13 such as a floor or ground. Portions of the compressed working fluid discharged from the compressor 30 can be transported through one or more conduits 40 to a sump or separator tank 50 for separating fluid constituents such as air and oil or the like. One or more coolers 60 can be operably coupled with the system 10 for cooling working fluids to a desired temperature in some embodiments. The one or more coolers 60 can cool working fluids such as compressed air or oil to a desired temperature. The compressor system 10 can also include a controller 100 operable for controlling the primary motive power source 20 and various valving and fluid control mechanisms (not shown) between the compressor 30 and coolers 60 such as a blow down valve 90. In the disclosed embodiment, the controller also operates the slide valve actuation in response to an excess or imbalance pressure in the conduit 82, that supplies compressed air to the end load/point of use/consumer. Such an excess pressure, beyond a threshold from the application pressure, would typically result when the supply of compressed air is more than the demand by the consumer. The controller thus initiates capacity control by part loading the compressor to mitigate the excess pressure. If the imbalance is not mitigated sufficiently even upon fully unloading the compressor, excess capacity is 'Blown-off' by means of valve 90, to the compressor inlet port.

The separator tank 50 can include a lid 52 positioned proximate a top portion 53 thereof. A seal 54 can be positioned between the lid 52 and separator tank 50 so as to provide a fluid-tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. An air supply conduit 82 can be operably coupled to the separator tank 50 so as to deliver compressed air to a separate holding tank or receiver tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10. In some forms, the compressor 30 can be a contact cooled screw compressor. In some alternate forms, the compressor 30 can be an oil-free screw compressor, in which case the oil circuit and elements, like separator tank 50, will not be present.

Figure 2:
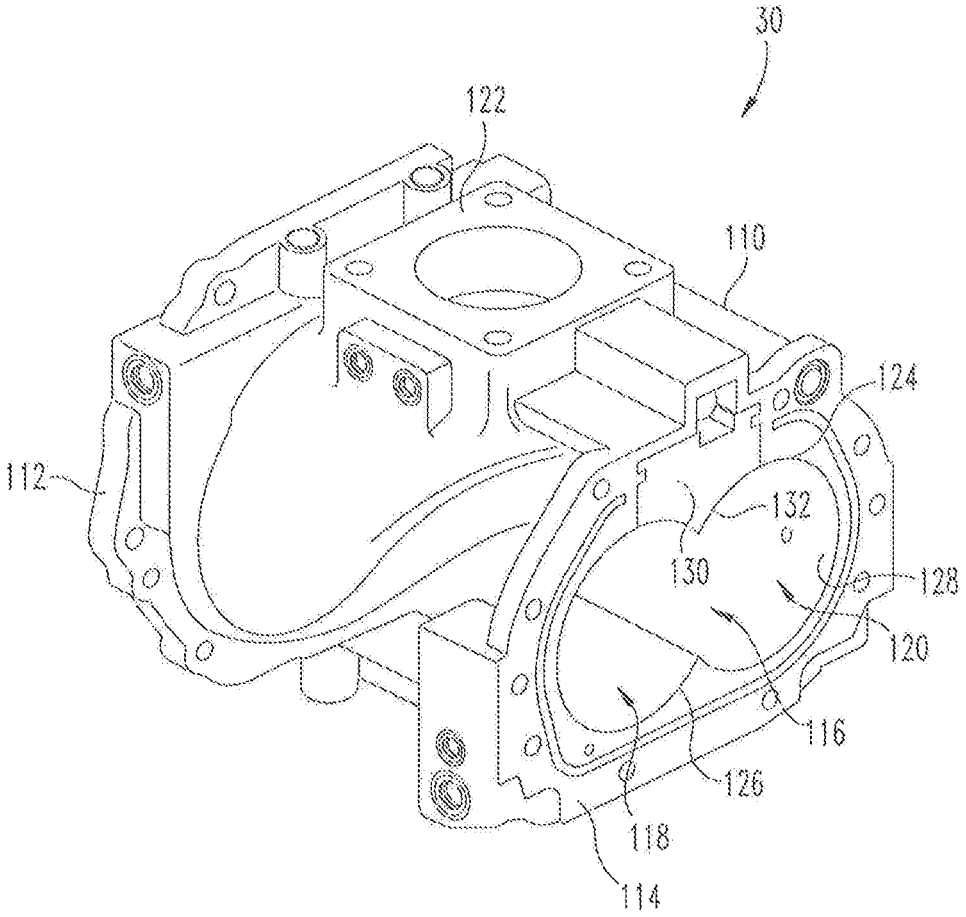
FIG. 2 is a perspective view of a compressor or rotor housing according to an embodiment of the present disclosure.

Referring now to FIG. 2, a perspective view of a rotor housing 110 is illustrated without some components such as male and female screw rotors to provide a clear view of certain internal features of the rotor housing 110. The rotor housing 110 can extend between a first end (suction face) 112 and a second end (discharge face) 114. A compressor chamber 116 extends between the suction and discharge faces 112 and 114 and is generally defined in conjunction with a pair of meshed male and female rotors (not shown). The meshed male and female screw rotors operate in a conventional manner. In general, a suction inlet volume is defined between an inlet portion of the housing 110 and the portion of the male and female screw rotors prior to meshing mating lobes of the male and female rotors at the initial compression start point (Helix). The working fluid fills the inlet volume and then is compressed by operation of the screw rotors as is known to those skilled in the art. The working fluid is then discharged from the rotor housing 110 after the working fluid is compressed. The rotor housing 110 includes a first rotor bore region 118 for one of a male or a female rotor to rotatably reside within and a second rotor bore region 120 for the other of the male or female rotor to rotatably reside within.

Figure 7A:
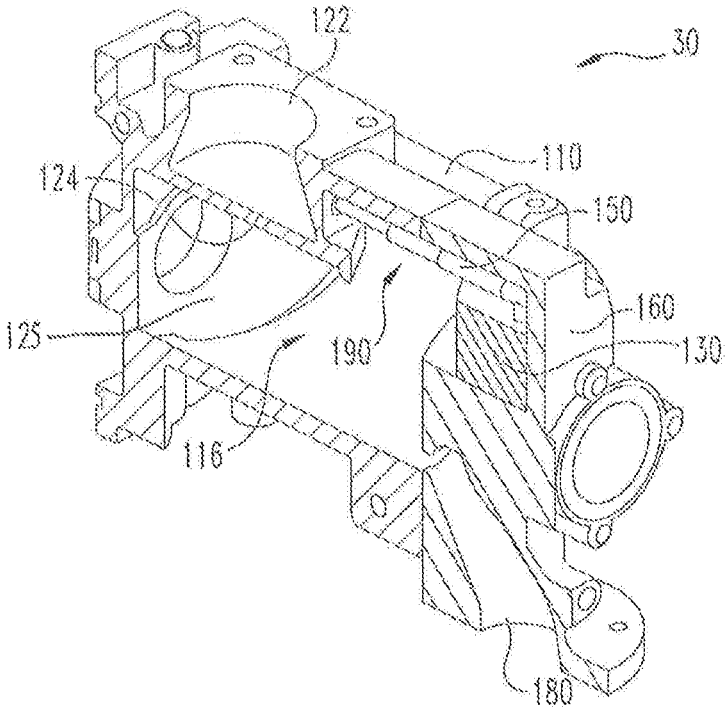
FIG. 7A is a perspective cutaway view of the rotor housing of FIG. 2 with the slide valve in a second position at the maximum unloaded operating condition.

An inlet opening 122 in fluid communication with a compressible working fluid source, such as ambient air or other compressible fluid source, provides a flow path for the working fluid to enter into the inlet port 125 (see FIG. 7A). The inlet port 125 is bounded by the inlet opening 122, the compression start helices 129, 131 (See FIGS. 8A and 9A) and the suction face 112 as one skilled in the art would readily understand. Here the fluid resides briefly until engaged by a pair of out meshing male and female lobe spaces at the suction end face of the rotors (not shown). The lobe spaces are filled with working fluid along a length of the rotor before again coming into mesh at the suction face 112. At this point the fluid space in the lobes is isolated from the inlet port 125 due to the compression start helices 129, 131 in the rotor housing 110. The fluid thus passes into the compression chamber 116 portion of the rotor housing 110, maintaining close clearance with the rotors, while essentially being isolated from the inlet port 125. The compressor chamber 116 has a less pressurized top half also known as a suction side 124, which is generally located at the top side or inlet opening (122) side of the first and second rotor bores 118, 120 in this exemplary embodiment. It should be understood, however in other embodiments the "suction side" of the compressor can be in other positions relative to a housing reference frame. For example, the suction side of the compressor can be at the top, bottom, side or intermediate locations in the housing 110. The suction side 124 of the housing 110 is generally understood as the lesser pressurized region of the compression chamber 116 bounded by the meshed rotor area, portions of bores of the rotor housing 110 after the compression start helix, portions of the discharge face 114 and the lobes at progressive stages of meshing, hence compression.

The rotor housing 110 further includes a discharge side 126 of the first and second rotor bores 118, 120 generally understood as the higher pressurized region of the compression chamber 116 bounded by the meshed rotor area, portions of bores of the rotor housing 110, the lobes at advanced stages of meshing proximate to the discharge port and lastly, portions of the discharge face 114. Similar to the suction side, the discharge side 126 can also be located at any relative location in the housing 110, however the discharge side 126 by definition is in a region where the working fluid has been compressed within the compression chamber 116. This is generally on the opposite side of the suction side region 124. The compression chamber 116 is further defined by a compression chamber wall 128 (same as the bore walls) that is fixed and provides a close tolerance fit with the outer diameter of the first and second rotors (not shown), the space between the rotors and the compression chamber wall 128 is minimized to mitigate leakage from high pressure regions to low pressure regions in the housing 110.

A suction side slide valve 130 defines a movable compression chamber wall 132 that is slidably coupled with the compression chamber 116 of the housing 110. The valve 130 is substantially similar in shape to the fixed portion of the compression chamber 116. The suction side slide valve 130 provides for a variable geometry compression chamber so that the compressor 30 can be run at part load conditions at higher efficiency than running a fixed geometry housing 110 or with other methods of capacity control described in the background. Operation of the suction side slide valve 130 is described in more detail below.

Figure 3:
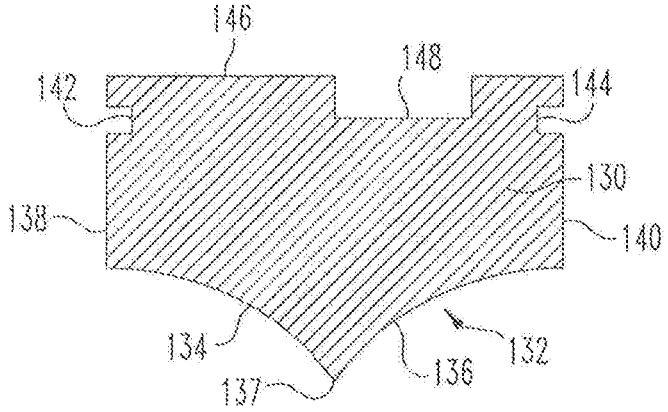
FIG. 3 is a cross-sectional end view of an exemplary suction side slide valve.

FIG. 3 is an end view of the suction side slide valve 130, shown from the discharge face, that is operable in the disclosed embodiment. The suction side slide valve 130 includes a movable wall 132 that is closely coupled to the screw rotors to maximize compression efficiency. The movable wall 132 includes a male rotor interface wall 134 and a female rotor interface wall 136 to provide a variable, sliding boundary for the compression chamber 116. The male interface wall 134 and a female interface wall 136 intersect at an intersection (cusp) point 137 which generally defines the intersect location of the male and female screw rotor bores. In some embodiments, the male and female rotor may be reversed. This intersection point 137 is on the suction side 124 (FIG. 2) of the rotor housing 110. The suction side slide valve 130 includes a first side wall 138 and a second side wall 140 on opposing sides. A first slide groove 142 is formed within the first side 138 and a second slide groove 144 is formed within the second side 140 of the suction side slide valve 130. The slide grooves 142, 144 provide guides (guide ways) for the suction side slide valve 130 to slidingly engage with the rotor housing 110 when moved between first and second positions corresponding to a full-load operating condition and fully unloaded operating condition. The suction side slide valve 130 can be moved to any location between the first and second positions to steplessly control capacity of the compressor 30 (FIG. 2) in part load operation. A top wall 146 extends between the first and second side walls 138, 140 and includes a guide channel 148 for enclosing an oil flow means or conduit through the slide valve (FIG. 4) formed in the rotor housing 110.

Figure 4:
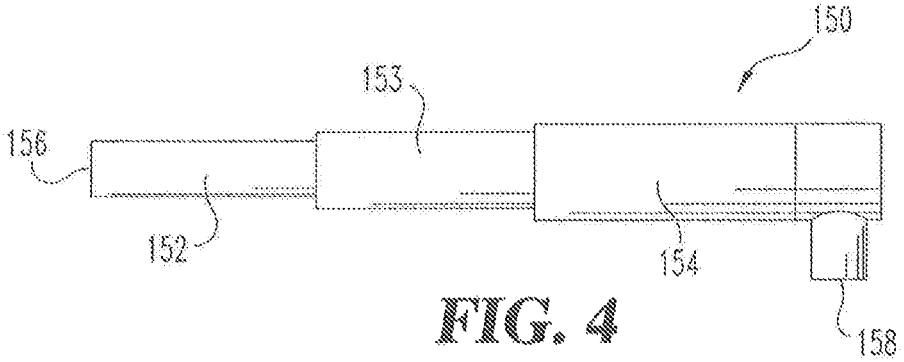
FIG. 4 is a perspective view of an exemplary actuator and/or telescopic oil injector for the slide valve of FIG. 3.

Referring now to FIG. 4, an actuator system having an actuator (not shown) and an exemplary actuator arm 150 can be connected to the slide valve 130 (FIG. 2) so that slide valve 130 can be moved to a desired location between the first and second positions. The actuator arm 150 may be of any known form, shape or size. In the exemplary embodiment, the actuator arm 150 can include telescopic sections 152, 153, 154, to provide extendable control of the length for moving the slide valve 130 between the first and second positions. The actuator arm 150 can include a lubricant inlet 156 and a lubricant discharge port 158 that is connected to the slide valve 130 in the guide channel 148 (FIG. 3) so that lubricant can be delivered to the compression rotors inside the screw chamber 116 (FIG. 2). The location of lubricant injection onto the rotors will vary as the slide valve 130 is moved to different locations between the first and second positions. In some forms the actuator may include a separate actuator arm (not shown) such that the arm 150 is merely a movable conduit connected to the slide valve 130.

Figure 5:
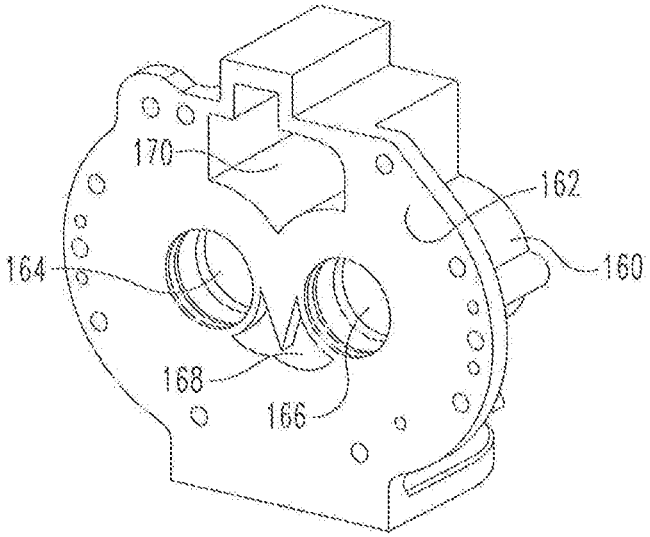
FIG. 5 is a perspective view of a discharge housing which is to be assembled to the rotor housing of FIG. 2.

Referring now to FIG. 5, a perspective view of a discharge housing 160 is illustrated. The discharge housing 160 can include an interface wall 162 that is sealingly coupled to the second side 114 of the rotor housing 110 (FIG. 2). The discharge housing 160 includes first and second bores 164, 166 to provide passageways for rotor shafts (not shown) and discharge end bearings of the male and female rotors 118, 120 (FIG. 2) to extend therethrough. An axial discharge port 168 can also be formed within the discharge housing 160 to provide a path for compressed fluid to exit through, being revealed at a particular rotation angle of the rotors. A valve chamber 170 can be formed within the discharge housing 160 to provide a space for the slide valve 130 (FIG. 2) to slide into when moved to the second position.

Figure 6A:
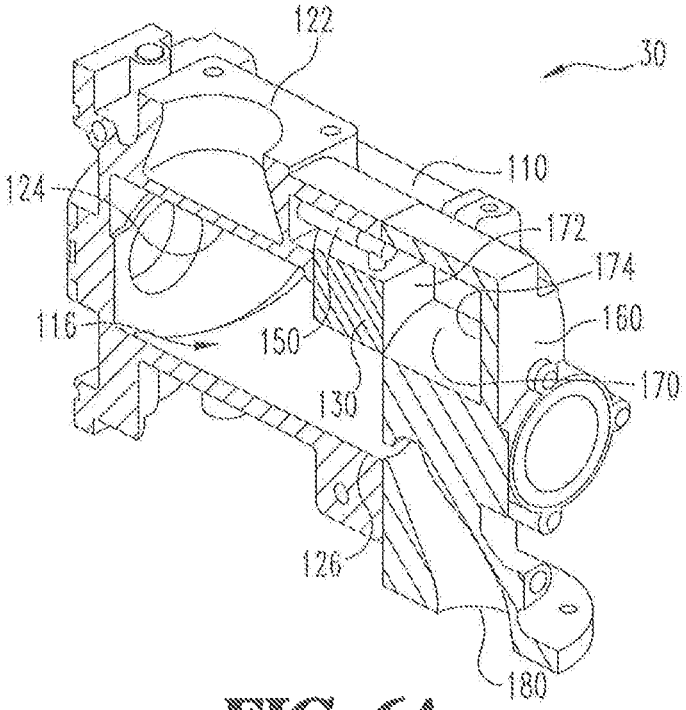
FIG. 6A is a perspective cutaway section view of the rotor housing of FIG. 2, taken at the intersection (cusp) of the two rotor bores, with the slide valve in a first position at a full load operating condition.
Figure 6B:
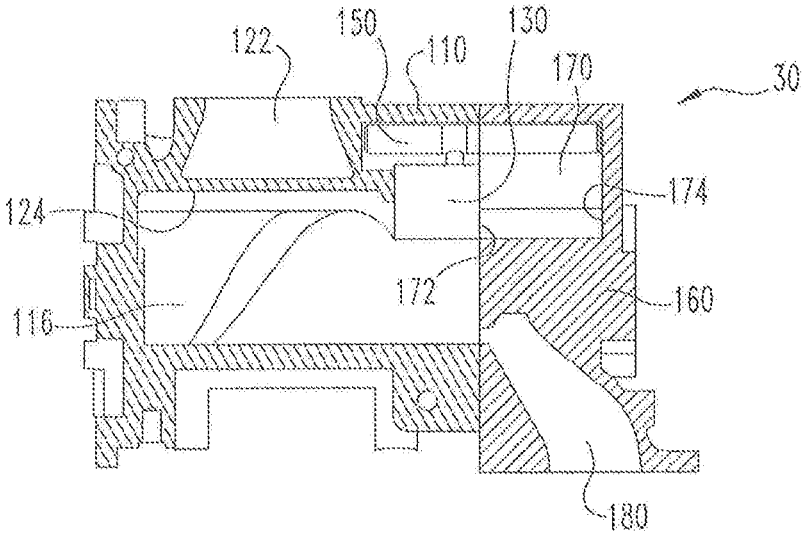
FIG. 6B is a cross-sectional side view of the rotor housing of FIG. 2 with the slide valve in a first position at a full load operating condition.
Figure 7B:
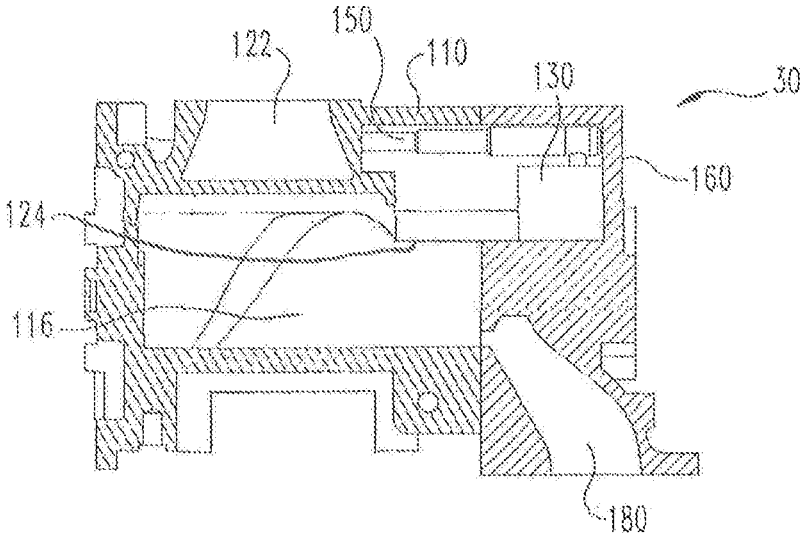
FIG. 7B is a cross-sectional side view of the rotor housing of FIG. 2 with the slide valve in a second position at the maximum unloaded operating condition.

Referring now to FIGS. 6A and 6B, the side valve 130 is shown in a first position which corresponds to a full load operating point of the compressor 30. The slide valve 130 is shown in a second position corresponding to a maximum unloaded condition in the perspective cut-away view of FIG. 7A and the cross-sectional view of FIG. 7B. Some of the features of the rotor housing 110 that have been previously described are not described again with respect to these figures. FIGS. 6A, 6B show another view of the valve chamber 170. The valve chamber 170 can extend between a first end 172 and a second end 174 which defines distal positions where the slide valve 130 can be located. In general, the working fluid is directed to an inlet port 125 and into the suction side 124 of the compression chamber 116. The actuator arm 150 is coupled to a controller (not shown) and is operable to receive command signals to move the slide valve 130 in a desired position depending on the operating condition of the compressor 30. When the working fluid is compressed in the compression chamber 116, the compressed fluid is discharged through the discharge opening 180 within the discharge housing 160.

Referring again to FIGS. 7A and 7B, the slide valve 130 is located in the second position or maximum unloaded operating condition. A suction volume bypass region 190 is formed on the suction side 124 of the compression chamber 116. In operation, when the working fluid enters the inlet port 125 and the slide valve 130 is in the second position as shown, the uncompressed inlet volume is in fluid communication with the suction volume bypass region 190 such that the screw rotor lobes cannot trap and compress the working fluid even though meshing of lobe spaces occurs. Therefore, the compressor 30 undergoes capacity reduction by recirculation or bypass of this length of rotor-lobe fluid volume and does not waste power compressing the working fluid in the unloaded condition.

Figure 8A:
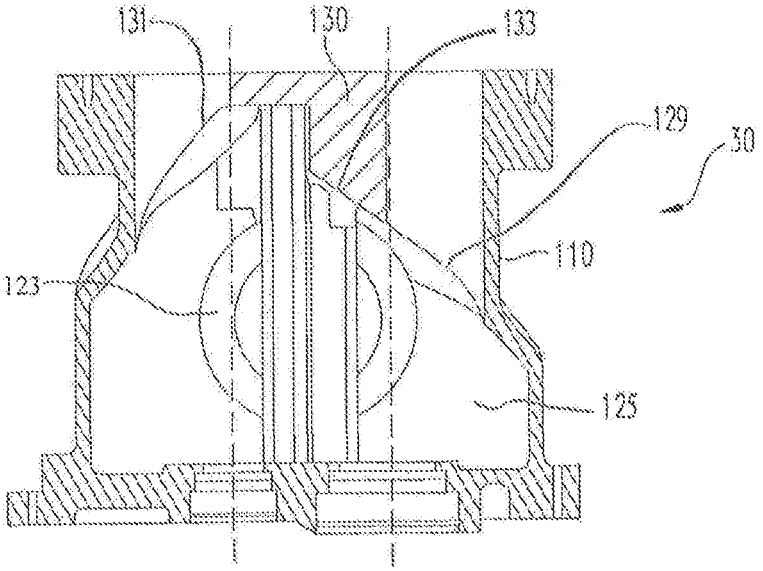
FIG. 8A is a top view in partial cross-section of the rotor housing of FIG. 2 with the slide valve in a first position at a full load operating condition.
Figure 8B:
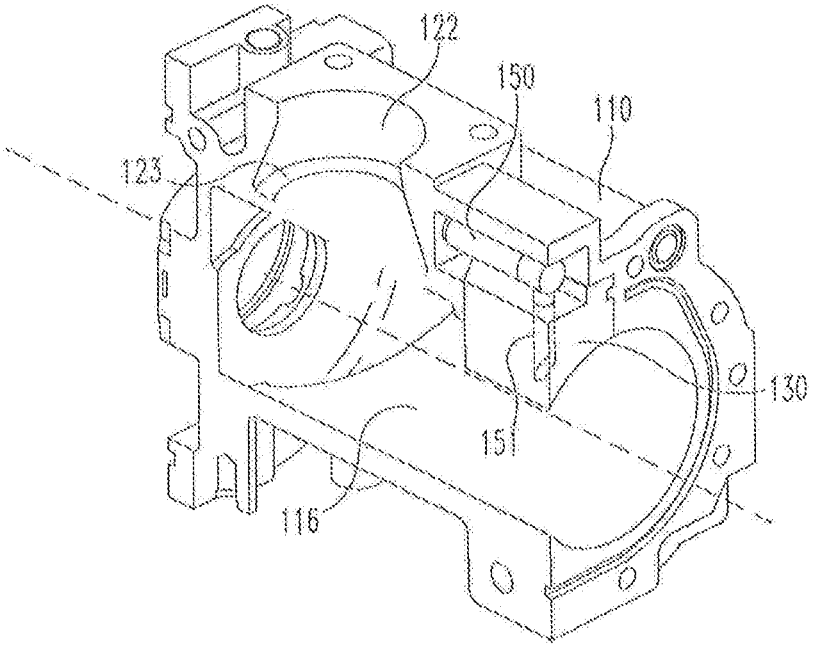
FIG. 8B is a perspective cutaway view of the rotor housing of FIG. 2 with the slide valve in a first position at a full load operating condition.

Referring now to FIGS. 8A and 8B, another view of the rotor housing 110 is illustrated. FIG. 8A shows the top view of the rotor housing 110 wherein the inlet opening 122 is in fluid communication with an inlet volume ingress path 123 for providing a pathway for working fluid to enter into the inlet port 125. The inlet port 125 will continuously supply fluid into the compression chamber 116 during normal operation. When the slide valve 130 is in the first position, the screw rotors will compress the fluid throughout the entire region where the rotor lobes are meshed within the compression chamber 116. A lubricant exit port 151 can transport lubricant from the actuator arm 150 to the compression chamber 116, so that oil is always injected at the same phase of compression of the working fluid. This applies even when progressively delayed compression occurs owing to the slide valve motion from a full load to a fully unloaded position.

Figure 9A:
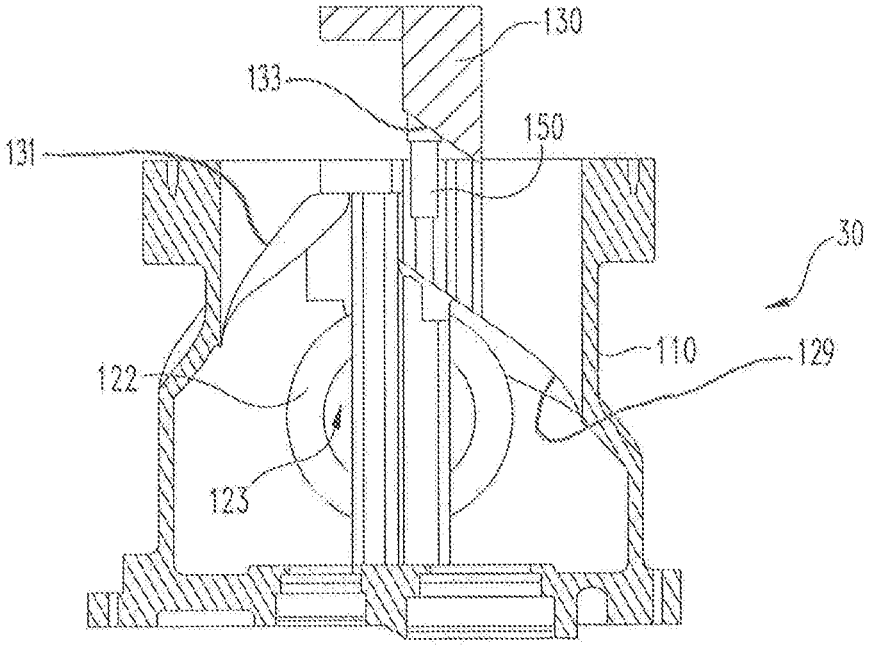
FIG. 9A is a top view in partial cross-section of only the rotor housing of FIG. 2 with the slide valve in a second position at an unloaded operating condition.
Figure 9B:
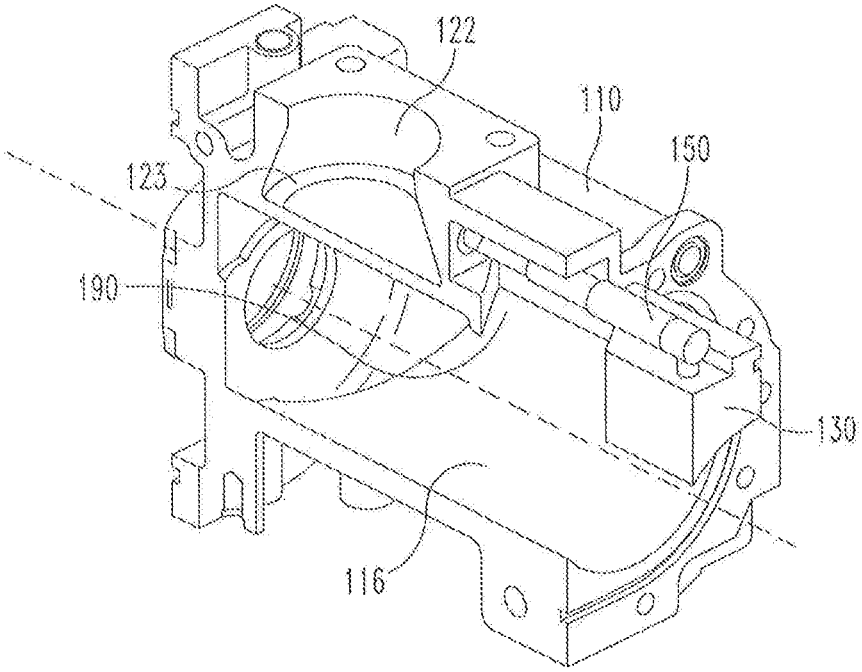
FIG. 9B is a perspective cutaway view of only the rotor housing of FIG. 2 with the slide valve in a second position at an unloaded operating condition.

Referring to FIGS. 9A and 9B, the slide valve 130 is in the second position which corresponds maximum unloaded condition the position of the slide valve 130 now defines the location where the initial compression point occurs within the compression chamber 116. When the suction slide valve 130 is in the second position the working fluid is not compressed even when the compressor 30 is operating. This condition exists until the rotating, lobe fluid volumes in the rotors crosses the compression start edge 133 on the slide valve, where upon compression though delayed, resumes with diminished capacity as entrapped in the rotor lobes. The suction side slide valve 130 can be moved anywhere between the first and second positions such that the compressor 30 can operate at part load or reduced load conditions with relatively high efficiency rate. The part load or reduced load may be approximately one-half full load in some embodiments and may be less than one-half full load in other embodiments.

In one aspect, the present disclosure includes a compressor system comprising: a rotor housing; a compression chamber positioned within the housing, the compression chamber having a suction side and a discharge side; male and female screw rotors rotatably meshed together within the compression chamber, the screw rotors operable for compressing a working fluid; an inlet opening connected to the housing upstream of the compression chamber; a discharge port connected to the housing downstream of the compression chamber; an inlet port defined between the housing and the screw rotors on the suction side of the housing prior to fluid compression; and a suction side slide valve operably connected to the housing, the slide valve movable between first and second positions defined as fully closed and fully open to vary the size of the inlet port.

In refining aspects, the present disclosure includes a compressor system wherein the slide valve is movable to an intermediate position at any location between the first and second positions; wherein the compressor operates at a full load, a part load and unloaded when the slide valve is in the first position, an intermediate position and the second position, respectively; wherein the slide valve is defined by a top wall extending between first and second side walls and male and female rotor interface walls opposite of the top wall; further comprising: a guide channel formed in the top wall of the slide valve; a first slide groove formed in the first side of the slide valve; and a second slide groove formed in the second side of the slide valve; an actuator arm connected to the slide valve; wherein the actuator arm includes a lubricant passageway operable to transfer lubricant to the slide valve; a discharge housing connected to the rotor housing; wherein the discharge housing includes a valve chamber configured to receive the slide valve when the slide valve is moved from the first position; and wherein the discharge housing includes an axial discharge port in fluid communication with the compression chamber.

In another aspect, the present disclosure includes a screw compressor wherein a rotor housing having an inlet, an outlet and a compression chamber positioned therebetween, the compression chamber having a suction side and a discharge side; a pair of screw rotors rotatably supported within the compression chamber; and a suction side slide valve in fluid communication with the compressor inlet, the suction side slide valve being movable between a closed position and a fully open position.

In refining aspects, the present disclosure includes a screw compressor wherein the screw compressor operates at one hundred percent load when the valve is in the closed position and at a reduced load in the fully open position; further comprising a controller operable for determining a load requirement for the compressor and an associated command position for the slide valve; an actuator coupled to the suction side valve operable for receiving control signals from the controller and moving the slide valve to a controlled position; wherein the slide valve is in fluid communication with the compressor inlet and forms part of a boundary for compression start helices; wherein the slide valve defines a movable boundary for an inlet suction volume region; and wherein the slide valve includes a lubricant exit port for discharging lubricant onto the screw rotors.

In another aspect, the present disclosure includes a method for controlling a screw rotor comprising: directing a working fluid into an inlet of a rotor housing, the rotor housing having a suction side and a discharge side; moving a suction side slide valve to a desired position on the suction side of the rotor housing to control a flow capacity of the compressor, the suction side slide valve defining a movable boundary of a suction inlet volume; filling the suction inlet volume with the working fluid; compressing the working fluid in a compression chamber defined by a pair of meshed screw rotors and the rotor housing; and discharging compressed working fluid.

In refining aspects, the present disclosure includes a method further comprising moving the suction side slide valve between a closed position and a fully open position, wherein the closed position defines a maximum load operating condition, the full open position defines an unloaded operating condition and intermediate positions define variable part load operating conditions; and sending control signals from a controller to the actuator to move the slide valve to a desired location between the first and second positions.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a rotor housing;

a compression chamber positioned within the housing, the compression chamber having a suction side and a discharge side;

male and female screw rotors rotatably meshed together within the compression chamber, the screw rotors operable for compressing a working fluid;

an inlet opening connected to the housing upstream of the compression chamber;

a discharge port connected to the housing downstream of the compression chamber;

an inlet port defined between the housing and the screw rotors on the suction side of the housing prior to fluid compression; and a suction side slide valve operably connected to the housing, the slide valve movable between first and second positions defined as fully closed and fully open to vary the size of the inlet port;

wherein the suction side slide valve is defined by a top wall extending between first and second side walls and male and female rotor interface walls opposite of the top wall; and wherein the compressor system further comprises a guide channel formed in the top wall of the suction side slide valve.

2. The compressor system of claim 1, wherein the slide valve is movable to an intermediate position at any location between the first and second positions.

3. The compressor system of claim 2, wherein the compressor operates at a full load, a part load and unloaded when the slide valve is in the first position, an intermediate position and the second position, respectively.

4. The compressor system of claim 1 further comprising:

a first slide groove formed in the first side of the slide valve; and a second slide groove formed in the second side of the slide valve.

5. The compressor system of claim 1 further comprising an actuator arm connected to the slide valve.

6. The compressor system of claim 5, wherein the actuator arm includes a lubricant passageway operable to transfer lubricant to the slide valve.

7. The compressor system of claim 1 further comprising a discharge housing connected to the rotor housing.

8. The compressor system of claim 7, wherein the discharge housing includes a valve chamber configured to receive the slide valve when the slide valve is moved from the first position.

9. The compressor system of claim 7, wherein the discharge housing includes an axial discharge port in fluid communication with the compression chamber.

10. A method for controlling a screw rotor comprising:

directing a working fluid into an inlet of a rotor housing, the rotor housing having a suction side and a discharge side;

moving a suction side slide valve to a desired position on the suction side of the rotor housing to control a flow capacity of the compressor, the suction side slide valve defining a movable boundary of a suction inlet volume and including a top wall having a guide channel formed therein;

filling the suction inlet volume with the working fluid;

compressing the working fluid in a compression chamber defined by a pair of meshed screw rotors and the rotor housing; and discharging compressed working fluid.

11. The method of claim 10 further comprising moving the suction side slide valve between a closed position and a fully open position, wherein the closed position defines a maximum load operating condition, the full open position defines an unloaded operating condition and intermediate positions define variable part load operating conditions.

12. The method of claim 10 further comprising sending control signals from a controller to the actuator to move the slide valve to a desired location between the first and second positions.

* * * * *